US005382018A

United States Patent [19]

Browne

[11] Patent Number: 5,382,018

[45] Date of Patent: Jan. 17, 1995

[54] METHOD OF INSTALLING PUTTING HOLE LINER AND COLLAR

[76] Inventor: Richard P. Browne, 26 Lazy La., The Woodlands, Tex. 77380

[21] Appl. No.: 176,764

[22] Filed: Jan. 3, 1994

Related U.S. Application Data

[63] Continuation-in-part of Ser. No. 959,389, Oct. 28, 1992, Pat. No. 5,316,292, which is a continuation-in-part of Ser. No. 766,056, Sep. 26, 1991, Pat. No. 5,180,162.

[51] Int. Cl.[6] ..... A63B 69/36

[52] U.S. Cl. ..... 273/34 R; 172/1; 172/19; 29/234

[58] Field of Search ..... 273/34 R, 34 A, 34 B; 29/234; 172/1, 19

[56] References Cited

U.S. PATENT DOCUMENTS 5,316,292 5/1994 Browne ..... 273/34 R

*Primary Examiner*—George J. Marlo
*Attorney, Agent, or Firm*—Alton W. Payne

[57] ABSTRACT

A simple, brightly colored, plastic collar is disclosed for greatly enhancing the visibility of the golf hole for players, spectator and televised golf events. The collar has a diameter essentially the same as a regulation hole and is installed in the cup adjacent the exposed earth wall between the lip of the hole and the hole liner. Furthermore, use of the collar enhances a retention of moisture in the earth around the lip to prevent drying and crumbling of the soil which can cause an initially sharp lip to become rounded. The collar preferably has thinner upper perimeter wall to insure that the reaction of an impinging golf ball against the cup wall having the collar installed is not substantially altered from the reaction of a ball impinging an earth surface of a cup not having the collar installed. The hole liner and collar are installed in the hole by using a golf cup setter having an enlarged diameter cylindrical section on which the collar is positioned, and a smaller diameter cylindrical section which engages the liner for pushing same into the hole, and simultaneously positions the collar in the hole above the liner and interlocks same therewith after the setter is removed.

1 Claim, 8 Drawing Sheets

METHOD OF INSTALLING PUTTING HOLE LINER AND COLLAR

CROSS REFERENCE TO RELATED APPLICATION

The present application is a continuation-in-part application of the copending patent application of Richard P. Browne, U.S. Ser. No. 07/959,389 filed on Oct. 28, 1992, now U.S. Pat. No. 5,316,292, entitled METHOD OF INSTALLING PUTTING HOLE LINER AND COLLAR, which is a continuation-in-part application of U.S. Ser. No. 07/766,056 filed on Sep. 26, 1991, entitled GOLF HOLE COLLAR, now issued as U.S. Pat. No. 5,180,162.

FIELD OF THE INVENTION

The present invention relates to the game of golf. More particularly, the present invention relates to an internal collar device for enhancing the visibility of a golf hole when a player is hitting a golf ball as well as maintaining the initial characteristics of the golf hole, the installation and relationship of the associated parts.

BACKGROUND OF THE INVENTION

To prepare natural grass golf greens for play, the greens are cored with an auger to create a regulation 4.25 inch diameter hole. A hard plastic liner is typically inserted to preserve the shape of the hole and hold a flag. Since proper putting velocity is a honed skill and because a ball stroked with excessive velocity may strike the back side of the hole and bounce out, it is undesirable that the ball strike hard plastic which is a relatively elastic surface compared to bare earth. Therefore, the cup liner is generally set about 1 to 1.5 inches beneath the grass surface leaving a bare earth strip. This earth surface at the top portion of the hole upholds traditional elements of the game and does not cause the ball to bounce out of the hole in an unwarranted fashion.

There are two main problems observed in the typical golf course which are solved by the present invention. Firstly, a natural colored background gives the hole relatively low visibility to greens players some yards distant from the cup. Lower visibility can increase a player's difficulty and worsen his score. Spectators both at the course and over a television broadcast also generally have difficulty seeing the hole. Such difficulties can reduce the pleasure of the event.

To overcome this basic difficulty, a golfer may typically use a person to "spot the cup" by holding the flag in place until the ball is struck. In televised tournament play, the exposed earth may be coated with white latex paint. However, this procedure requires a special paint spraying apparatus which is expensive, time consuming to use and the paint flakes off over time and use.

A second well known difficulty results when the exposed earth portion of the hole drys out during the day and gets trodden. The hole lip, originally sharp, can become rounded as the soil drys and crumbles and wears from play. This may present players at the end of the day with greater (but unfair) opportunity to get a ball, which might otherwise hang on the lip, to drop in the hole. This is particularly a problem for golf courses which do not relocate each hole every day.

U.S. Pat. No. 4,108,439 to McGuire describes a protector and marker device for an imbedded sprinkler head as might be found on a large lawn including golf courses. The device is tubular shaped with a flange ring attached to the outer edge. The device is forced into the ground surrounding the sprinkler head. The ring acts to mark the sprinkler head and limits the depth of the insertion. The ring can include indicia indicating the distance from the cup when used on golf courses.

U.S. Pat. No. 4,280,698 to Troiano describes a putting aid and golf cup cover device. This device is designed to be used during practice sessions to improve one's putting accuracy. By reducing the diameter of the cup and simulating artificial grass on the cup lip, a player will increase his putting accuracy. This device uses flexible finger members against the inside of the cup to secure a position over the cup.

U.S. Pat. No. 4,878,665 to Boudreau et al. describes a golf cup unit having an insert disc mounted within the cup at the bottom thereof and twist-on connections for attaching the disc to the cup unit. Advertisements can be printed on an upper face of the disc for viewing by a golfer after the flag is removed.

U.S. Pat. No. 4,900,023 to Gelina describes a golf putting aid made from a cylindrical insert made from spongy rubber material fitted at the top of the cup. The device is designed to reduce the diameter of the cup to force a player to have greater putting accuracy.

U.S. Pat. No. 5,029,856 to Bookspan describes a golf cup for artificial greens comprising a golf cup having an inserted cylindrical layer of a compressible substance (e.g. rubber) secured to the upper end of the cup. The layer is said to closely approximate the frictional contact between a golf ball and the grass/root transition area of a real grass golf hole.

It is, therefore, a feature of the present invention to provide a golf hole collar which in normal use provides high visibility while improving both the hole conditions and performance of the golfer.

A feature of the present invention is to provide a golf hole collar which improves the consistency of golf hole characteristics.

Another feature of the present invention is to provide a golf hole collar which reduces golf course maintenance costs.

Another feature of the present invention is to provide a golf hole collar which improves golf hole visibility for players, spectators and the television coverage of golfing events.

Another feature of the present invention is to provide a golf hole collar which is inexpensive, simple to use and stays firmly in place.

Yet another feature of the invention is to provide a golf hole collar which does not change the dimensions of the golf hole itself.

Still another feature of the invention is to provide a golf hole collar which does not change the compression characteristics of the golf hole itself.

Another feature of the present invention is to provide a golf hole collar which assists in holding the shape of the hole.

Another feature of the present invention is to provide a golf hole collar which prevents the hole from collapsing.

Yet another feature of the present invention is to provide a golf hole collar which acts as a "target" which is highly visible to the golfer.

Still another feature of the present invention is to provide a golf hole collar which is easily installed without any special tools.

Yet another feature of the present invention is to provide a golf hole collar wherein the exterior surface includes a plurality of radial cleats for better attachment to an earthen golf hole.

Another feature of the present invention is to provide a golf hole collar wherein the base of said collar is relatively thicker than the upper wall portion to adapt to the varying size of the golf hole liner.

Additional features and advantages of the invention will be set forth in part in the description which follows, and in part will become apparent from the description, or may be learned by practice of the invention. The features and advantages of the invention may be realized by means of the combinations and steps particularly pointed out in the appended claims.

SUMMARY OF THE INVENTION

A simple brightly colored plastic collar device installed adjacent an exposed earthen wall between a lip of a golf course hole and a golf hole liner greatly enhances the visibility of the hole for players and spectators. Furthermore, use of the collar enhances the retention of moisture in the earth around the lip to prevent drying and crumbling of the soil which can cause an initially sharp lip to become rounded.

In one embodiment, the present invention provides a device for increasing the visibility of a golf hole installed adjacent an earthen strip between a lip of the hole and a golf liner, comprising a brightly colored, cylindrical collar having upper and lower perimeters and an outside diameter essentially the same as the inside diameter of the golf hole. The collar preferably imparts an absence of elastic reaction to an impinging golf ball, is sufficiently stiff to retain the regulation diameter, is sufficiently flexible to permit temporary collapse of the diameter for insertion and removal from the hole and comprises a moisture barrier.

In another embodiment, the collar has a plurality of tabs extending upwardly around the upper perimeter which enhances the flexibility of the collar for reducing the potential elastic response of an impinging golf ball.

The collar is preferably made from a thermoplastic or elastomeric material which has a yellow, orange, red or white color.

BRIEF DESCRIPTION OF THE DRAWINGS

The accompanying drawings which are incorporated in and constitute a part of the specification, illustrate a preferred embodiment of the invention and together with the general description of the invention given above and the detailed description of the preferred embodiment given below, serve to explain the principles of the invention.

The above general description and the following detailed description are merely illustrative of the generic invention, and additional modes, advantages, and particulars of this invention will be readily suggested to those skilled in the art without departing from the spirit and scope of the invention.

DETAILED DESCRIPTION OF THE PREFERRED EMBODIMENTS

Reference will now be made in detail to the present preferred embodiments of the invention as described in the accompanying drawings.

A flexible, brightly colored collar installed in a golf hole adjacent the bare earth section at the top of the hole presents an excellent visual target for players, spectators and televised matches. The collar is made from soft plastic in a manner which does not substantially change the elastic response of the impinging ball compared to bare earth. The collar is easy to install and keep in place.

Figure 1:
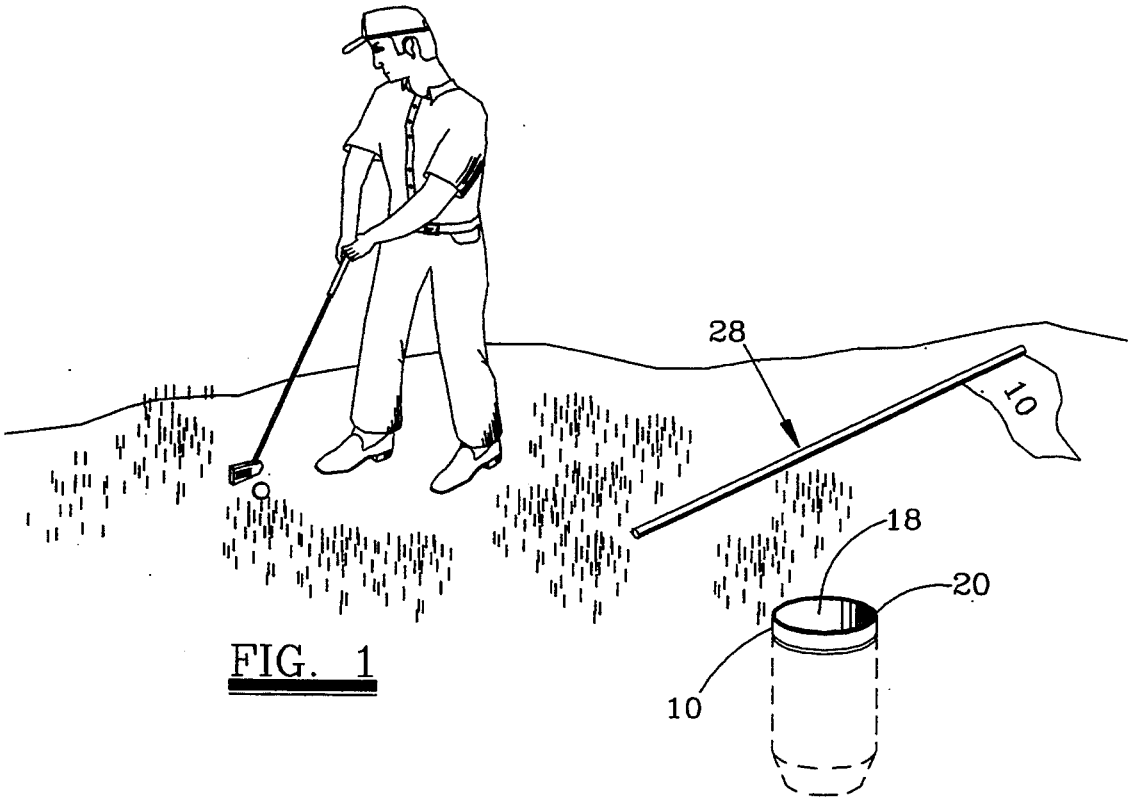
FIG. 1 is a perspective view of the present invention being used on a golf course.
Figure 2:
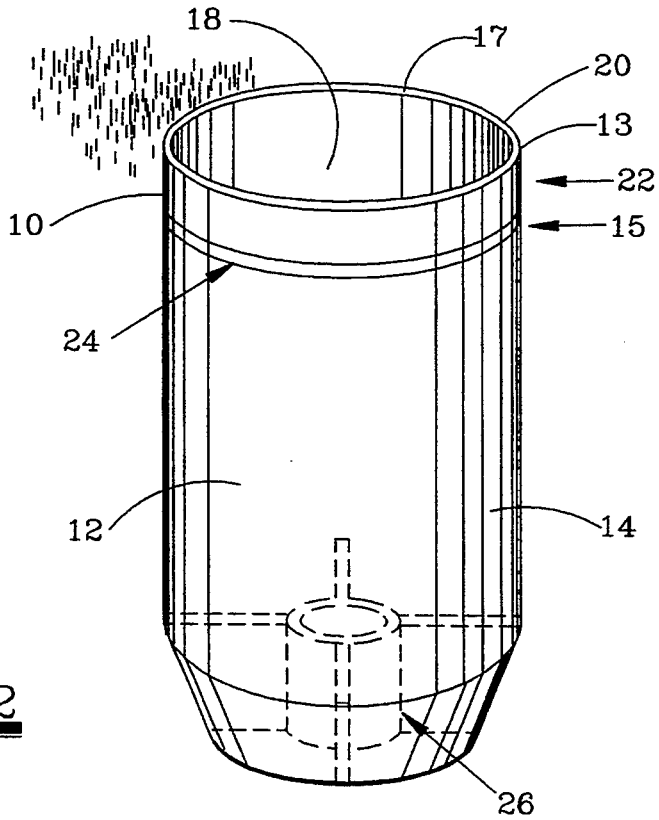
FIG. 2 is a perspective close-up view of a cup seen in FIG. 1 showing the present invention installed therein.

Referring to FIGS. 1 and 2, a golfer putting a golf ball on a golf green some yards distant from a golf cup 12 has a good visibility target to aim for because a brightly colored collar 10 of the present invention is installed in the cup 12 above a liner 14 but below a lip 20 of a hole 18 defined by the cup 12. The liner 14 is typically used to give integrity to the hole 18 and provide a stand 26 for a flag 28. Therefore, the liner is preferably made from hard plastic or metal.

Figure 3:
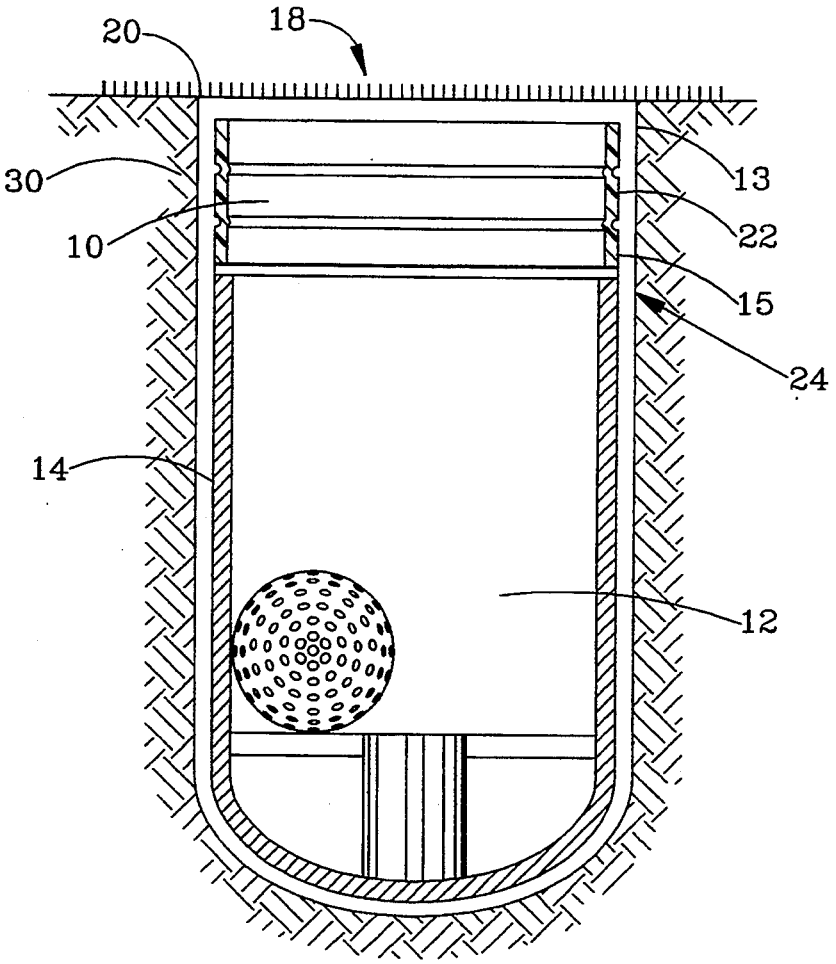
FIG. 3 is a cross-sectional view of the cup showing the present invention installed therein.
Figure 4:
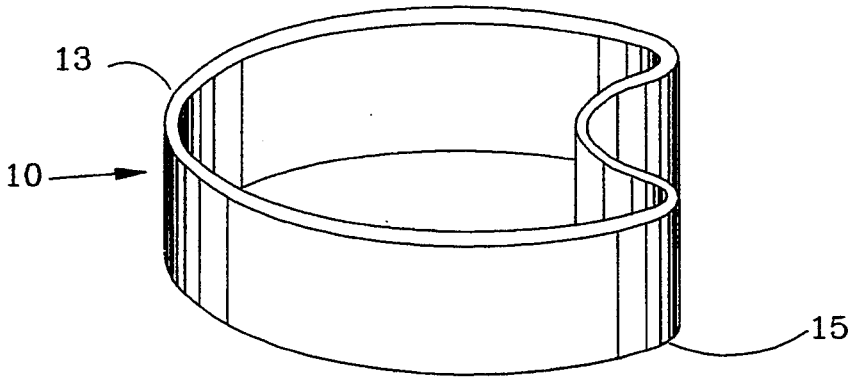
FIG. 4 is a perspective view showing the flexibility of the present invention prior to installation.

Referring to FIGS. 2, 3 and 4, the present invention comprises a flexible, brightly colored, cylindrical collar 10 having an upper perimeter 13, a lower perimeter 15 and an inside diameter at the upper perimeter 13 which is essentially the same as a regulation golf hole, about 4.25 inches. The collar 10 preferably has an overall outside diameter the same as the support liner 14.

The collar 10 is installed in a position around the top side 22 of the golf cup 12 adjacent an otherwise exposed earth wall 30 between the lip 20 of the hole 18 and the liner 14. A preferred collar 10 has a side length defined by the upper perimeter 13 and the lower perimeter 15 extending from a top edge 24 of the liner 14 to a position approximately 1/8 to 1/4 inch beneath the lip 20. The liner 14 can be conveniently used to support the collar 10 at the lower perimeter 15.

Bright color is an essential property of the collar 10. Examples of useful high visibility colors include yellow, orange, red, white and the like. Such colors may have various shades and attributes for different applications such as fluorescence.

As another important property, the top of the collar 10 has an elasticity similar to that of the bare earth. Alternatively, the collar 10 has a thin wall 17 or is made from a relatively soft material so that the elasticity of the collar 10 is minor in comparison to the adjacent earth surface 30. It is desirable that the present invention not substantially alter the reaction of a golf ball inpinging the side 22 of the cup 12 having the collar 10 installed over the reaction of the ball impinging the ordinary earth surface 30.

As a further property, the collar 10 is relatively stable or springy to retain the regulation diameter and position in the cup. Such stiffness can be conventionally obtained by various means including increasing the wall thickness 17 in the lower perimeter 15.

In addition, the collar 10 provides a nominal moisture barrier reducing an ordinary rate of moisture loss from the earth surface 30 to the air.

In a preferred embodiment, the collar 10 has tabs 16 extending upwardly around an upper perimeter 13. Tabs 16 can be used to further reduce the elastic response of the collar 10 and to frictionally engage the earth surface 30 to prevent any movement of the installed collar 10 when struck by a golf ball.

The collar 10 of the present invention may be made from thermoplastic or elastomeric materials, for example. Such materials include low density polyethylene, polystyrene, synthetic rubber, and the like which are readily available commercially.

Installation of the collar 10 is easily made by partially collapsing one side of the collar 10 to reduce the overall diameter, as illustrated in FIG. 4, then returning the deflected side to its normal undefiected state once positioned in the hole. For an elastic collar 10, the deflected side would normally return to an undeflected sate when the force causing the deflection is removed. Retreival of the liner 14 effects the removal of the collar 10, as the collar 10 rests upon the liner 14 and is automatically removed when the liner 14 is retreived.

Figure 5:
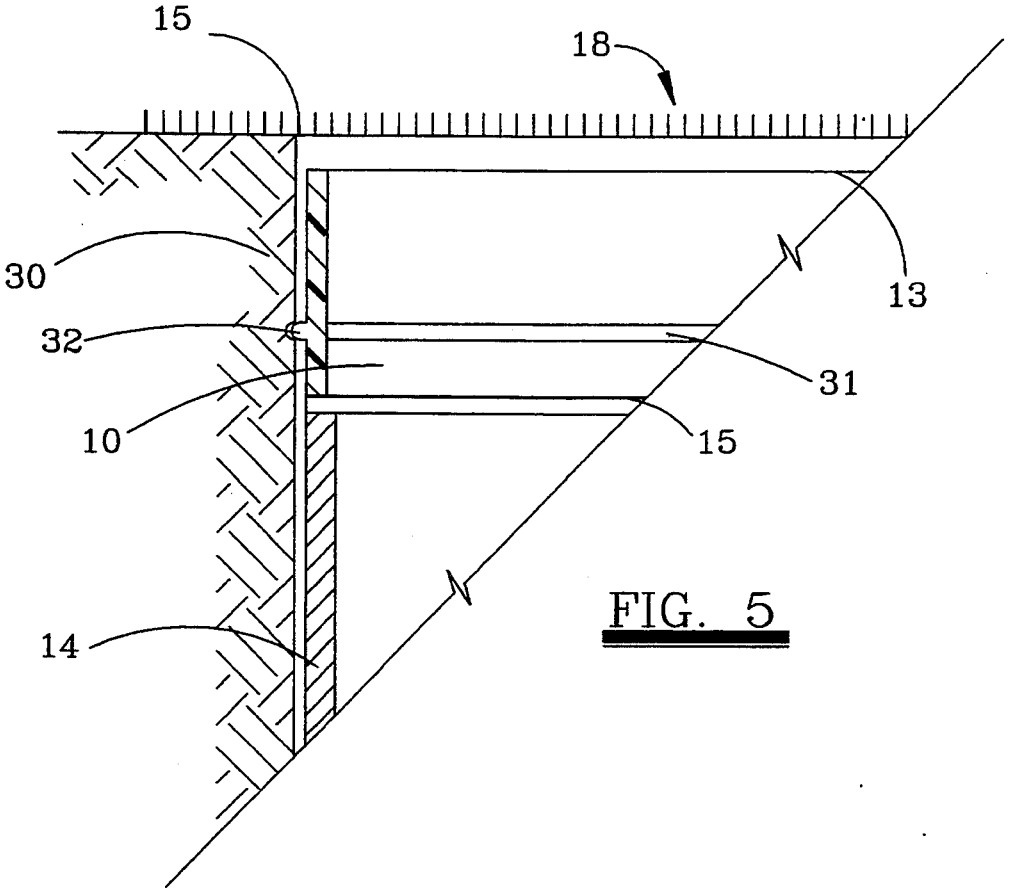
FIG. 5 is a cut-away view showing the engagement between the soil and the upper portion of the present invention after installation.

FIG. 5 demonstrates, by enlargement, several additional features of the present invention. An indentation 31 in the collar 10 assures an easy outward flex or force by the tabs 16 to assure no resistance greater than the earth 30 exists in the upper portion of the golf hole. The outward flex or force of the tabs 16 prevents an unnatural bounce, which is not desirable. The indentation 31 does not compromise nor reduce the desirable stability of the tabs 16 in resisting forces from the outside of the collar 10 inward.

FIG. 5 illustrates a circumferential "welt" 32 around the collar 10 which will anchor the collar into place by simply compressing into the side of the exposed earth 30 of the golf hole 18. When the collar is inserted into the hole 18 and resumes its present circular shape.

Figure 6:
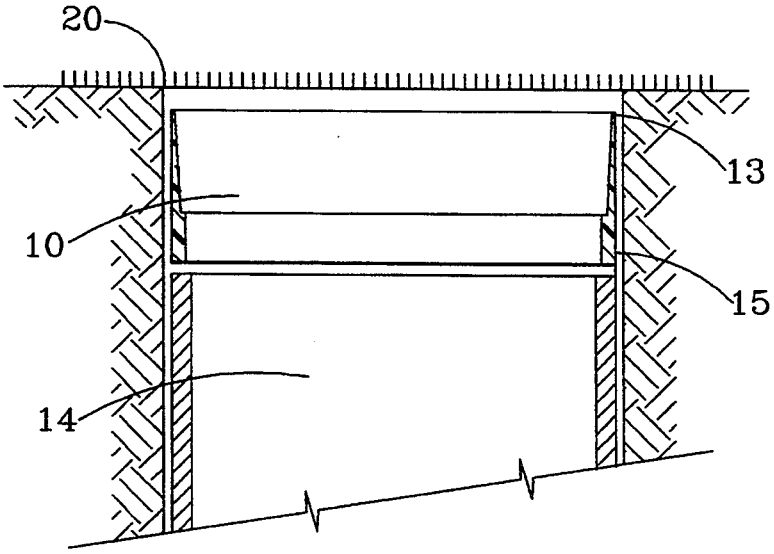
FIG. 6 is a cross-sectional cut-away view showing the present invention as it sits upon the golf cup protecting the strip of bare earth, but is positioned below the surface of the golf green.

FIG. 6 illustrates the relationship between the collar 10, the liner 14 and the lip 20. The upper perimeter 13 of the collar 10 is well below the surface of the lip 20. The lower perimeter 15 of collar 10 is supported by the top of liner 14.

Figure 7:
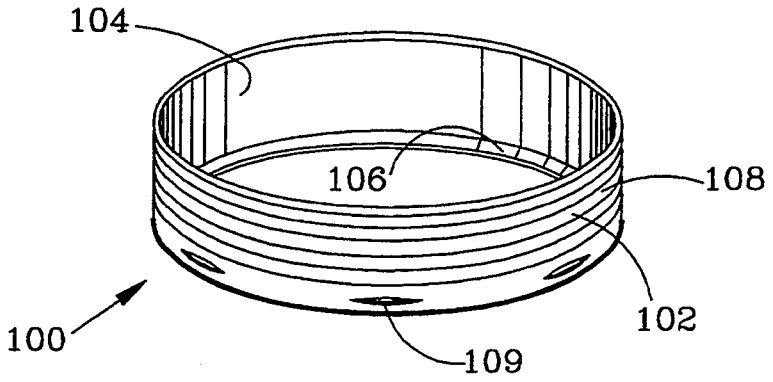
FIG. 7 is a perspective view showing the preferred embodiments of the present invention.

Referring now to FIG. 7, the collar 100 comprises primarily an exterior wall 102, an interior wall 104 and an inclined portion 106 of the interior wall 104. The exterior wall 102 has detents 108 which result in a rough surface and one or more cleats 109 which engage the earthen strip and secure the collar 10 in place. The interior wall 104 is a smooth polished surface, including the inclined portion 106.

Figure 13:
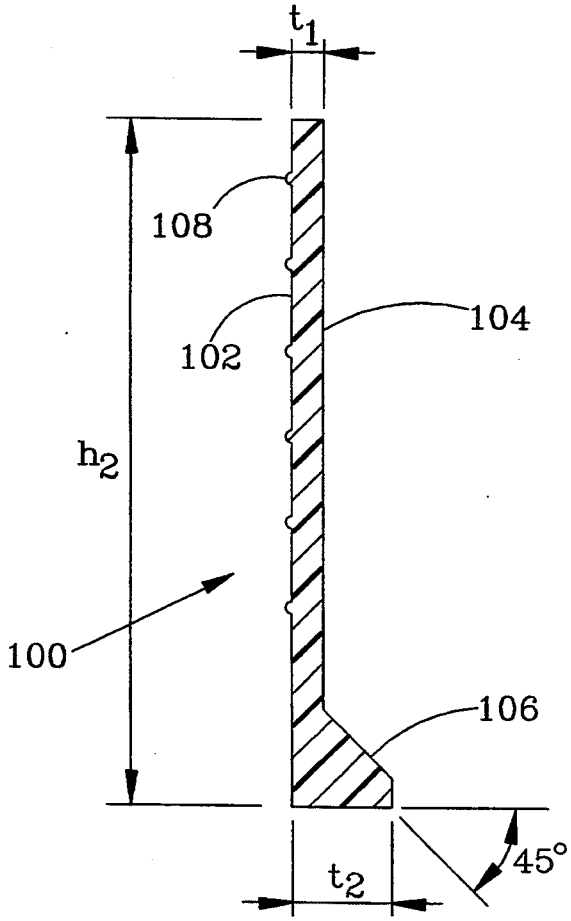
FIG. 13 is a cut-away cross section view of the present invention illustrating the relative thicknesses, heights, angles and structures.

Referring now to FIG. 13, the opening side thickness $t_1$ of the upper portion of the collar 100, with respect to the opening of the golf hole 18, is uniform. The ground side thickness $t_2$ of collar 100 is also uniform. It can be appreciated that the relationship between the ground side thickness $t_2$ and the opening side thickness $t_1$ is that the ground side thickness $t_2$ can be 2 to 10 times thicker than the opening side thickness $t_1$.

The inclined portion 106 of the interior wall 102 can be any angle between 0° and 90°. The 0° reference is indicated by a line orthogonal to the interior wall 104. Due to the slight variances in golf cup 12 diameters, the exterior wall 102 of the present invention 10 is designed with a base section $t_2$ slightly thicker than the wall section $t_1$ to compensate for the slight variations of golf hole cups 12 and further, enables the present invention 10 to rest on virtually any golf cup 12.

Figure 8:
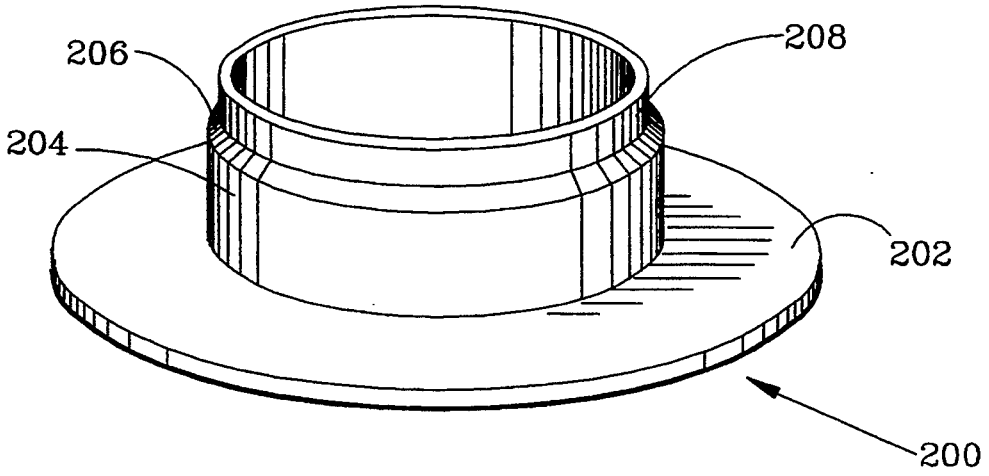
FIG. 8 is a perspective view of the cup-setter which is used to properly position the present invention upon the golf cup.

FIG. 8 illustrates a cup-setter 200. The cup-setter 200 comprises a planar member 202, a first cylindrical member 204, a beveled portion 206 and a reduced cylindrical member 208. The cup-setter 200 is provided to engage a typical golf hole as illustrated in FIG. 1.

Figure 9:
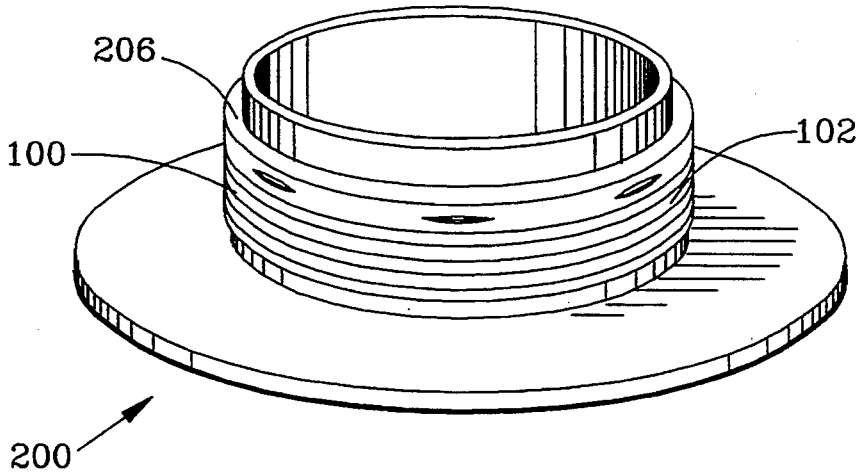
FIG. 9 is a detailed perspective view of the cup-setter with the present invention affixed on the cup-setter.

FIG. 9 illustrates the collar 100 affixed to the cup-setter 200. The collar 100 is placed over the reduced cylindrical member 208 such that it passes in channel therewith. The collar 100 rests in channel relationship with the cylindrical member 204. The beveled portion 206 of the cup-setter 200 is engaged with the inclined portion 106 of the collar 100. The interior wall 104 of the collar 100 is substantially parallel to the cylindrical member 204 of the cup-setter 200.

Figure 10:
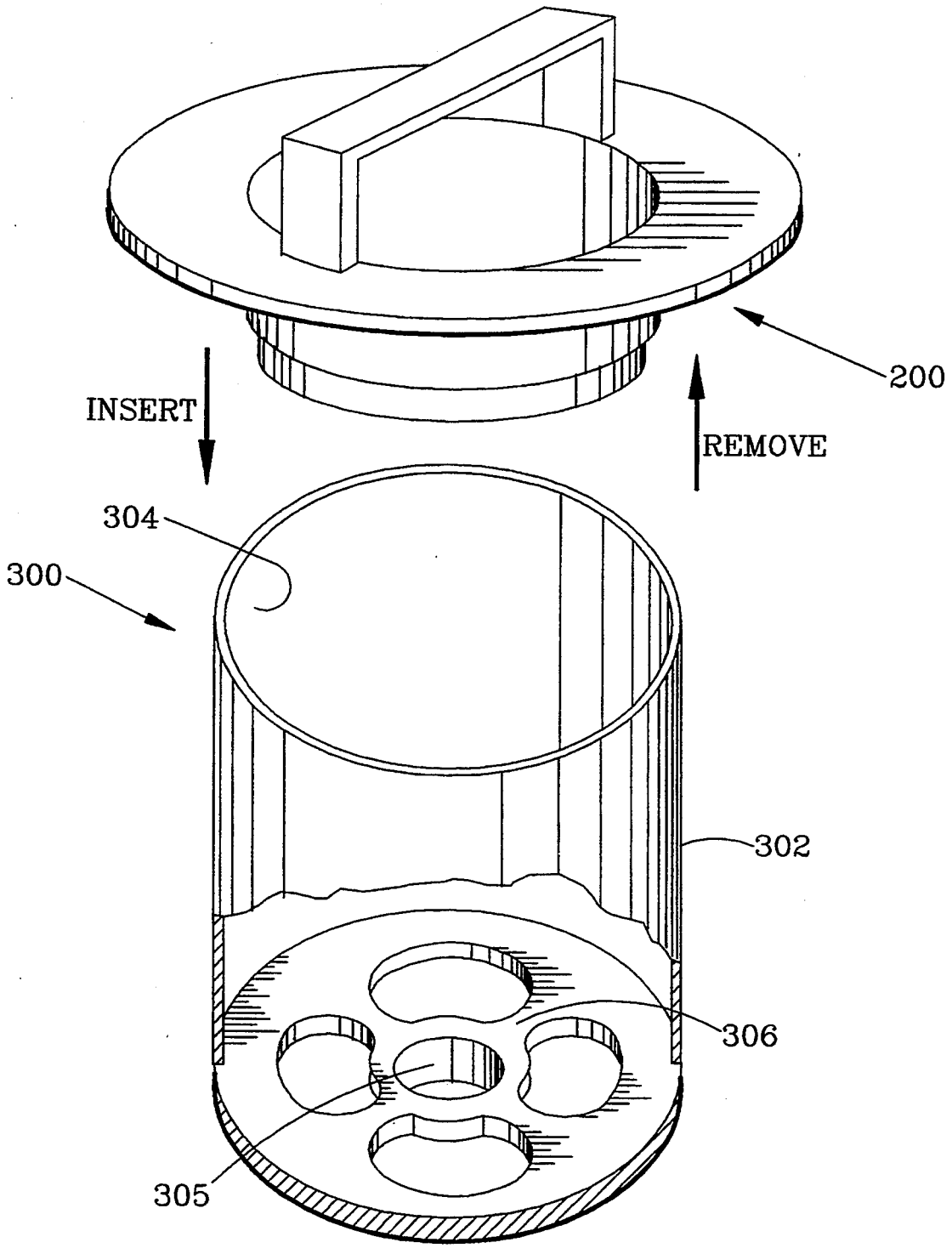
FIG. 10 is a perspective view of the cup-setter and a cutaway perspective view of the golf cup liner, illustrating the relationship between the cup-setter and the golf cup liner.

FIG. 10 illustrates the cup-setter 200 in spaced relationship with the cup liner 300. The cup liner 300 comprises an exterior wall 302, an interior wall 304, and a concaved bottom 306. The concaved bottom 306 also comprises a pole support 305.

Figure 11:
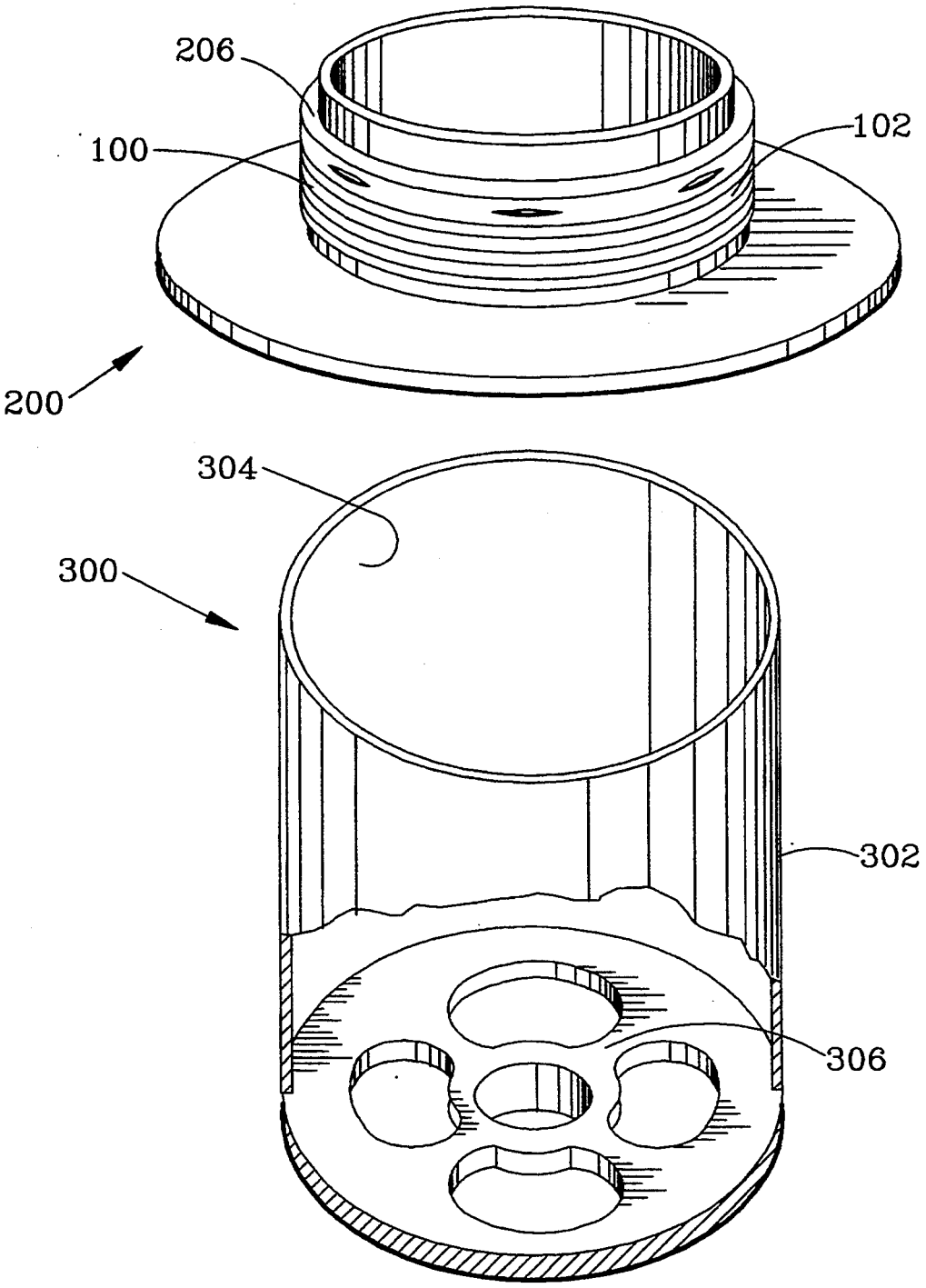
FIG. 11 is an inverted perspective view of the cup-setter with the present invention affixed to the cup-setter and a cut-away perspective view of the golf cup liner, illustrating the relationship between the cup-setter and the golf cup liner.

FIG. 11 illustrates the cup-setter 200 after having received the collar 100. Also, the cup liner 300 is illustrated to give perspective to the relationship between the collar 100, the cup-setter 200 and the cup liner 300.

Figure 12:
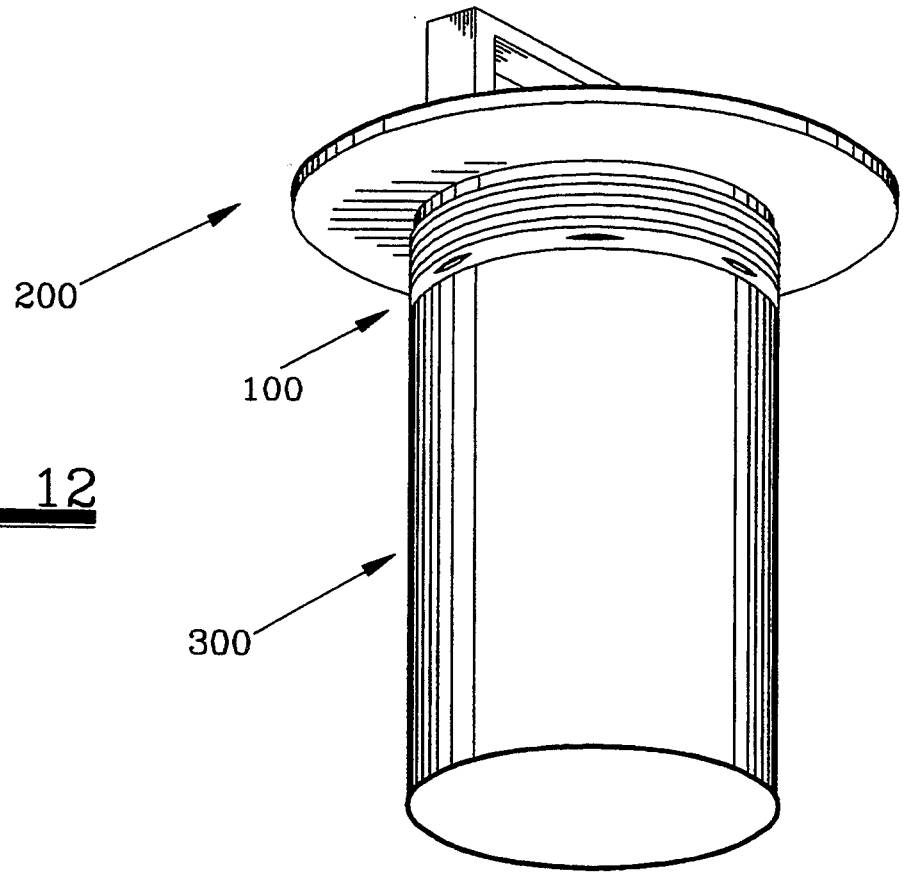
FIG. 12 is a perspective view of the cup-setter and golf cup liner with the present invention affixed on the cup-setter and in contact with the golf cup liner.

FIG. 12 illustrates the collar 100 removably engaged with the cup-setter 200, and the cup liner 300 removably engaged with the cup-setter 200 and the collar 100. The unit comprising the collar 100, the cup-setter 200 and the cup liner 300 is placed into the golf hole made by an auger at a predetermined diameter to receive an official sized cup liner 300. The depth of the golf cup liner 300 is fixed to specification based upon the engagement of the planar member 202 of the cup-setter 200 with the top of the grass of the green in which the hole is made. After the entire unit is fixed into the hole as deep as possible, the cup-setter 200 is lifted from the hole. The collar 100 has a distance offset from the planar member 202 of the cup-setter 200 such that it engages the interior of the golf hole at approximately one quarter of an inch below the surface.

Figure 14:
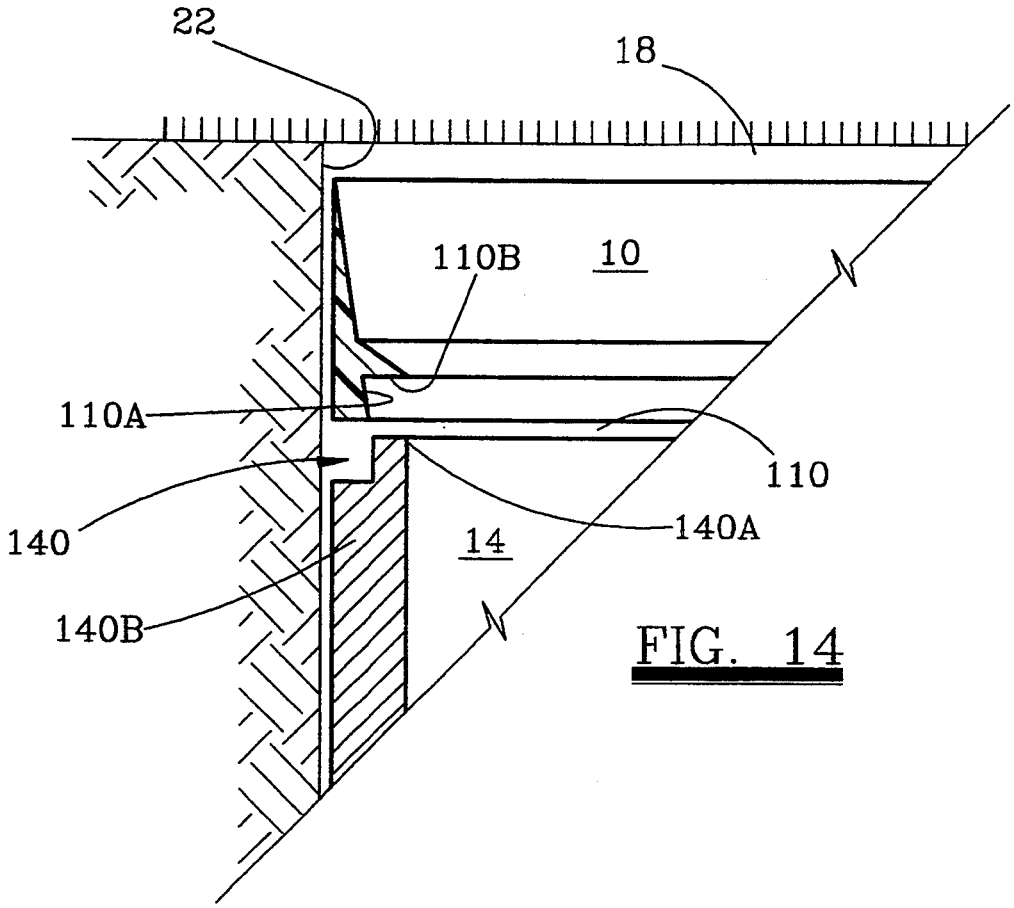
FIG. 14 is a cut-away cross section view of the present invention illustrating the relationship of the target and the liner.

FIG. 14 illustrates the relationship between the target 10 and the cup liner 14. The target 10 has a geometrical configuration 110, illustrated in its simplest form as a notch 110. The cup liner 14 also has a geometrical configuration 140 for engaging the geometrical configuration 110 of the target 10. The configuration 110 of the target 10 provides for a protruding element 110. The engaging portion of the cup liner 14 provides for an ingressing element 140. The elements 110, 140 provide for an interlocking relationship which secures the target 10 with respect to the cup liner 14. The configuration 110 comprises a vertical cylindrical surface 110A and a horizontal cylindrical surface 110B. Similarly, the notch 140 has a vertical cylindrical surface 140A and a horizontal cylindrical surface 140B. The respective notches 110, 140 engage each other to provide a removable, yet fixed, relationship between the target 10 and the cupliner 14.

Figure 15:
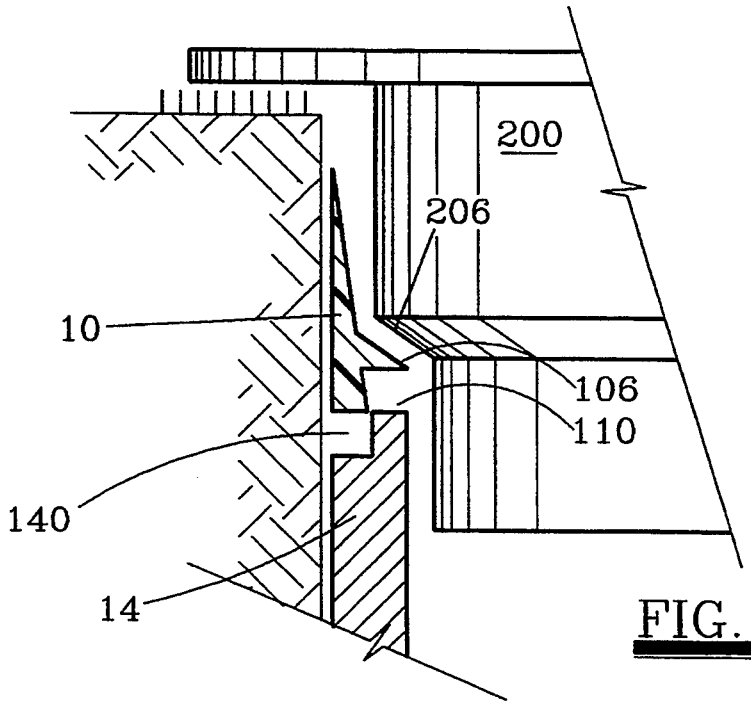
FIG. 15 is a cut-away cross section view of the present invention illustrating the relationship of the target, the liner and the setter.

FIG. 15 illustrates the invention of the present application which provides for the forceful securing of the target 10 with the liner 14 using a cup setter 200. The typical cup setter 200 provides for a squared edge to engage the top of the liner 14. In the present invention, an inclined relationship is provided between the cup setter 200 and the target 10. The cup setter 200 has an incline surface 206. The target 10 has an incline surface 106. The respective incline surfaces 206, 106 engage for having an expanding and forceful relationship between the cup setter 200 and the target 10. The expanding relationship caused by the inclined surfaces 206, 106 provide that the notches 110, 140 better engage. It is apparent to those skilled in the art that other geometric relationships are possible. For example, multiple notches, curved surfaces, interlocking surfaces, and the like.

Modifications of the shown solution are of course within the scope of the inventor and manufacturer of the invention such that the product characteristics are assured.

Additional advantages and modification will readily occur to 5 those skilled in the art. The invention in its broader aspects is therefore not limited to the specific details, representative apparatus, and the illustrative examples shown and described herein. Accordingly, the departures may be made from the details without departing from the spirit or scope of the disclosed general inventive concept.

What is claimed is:

1. A method for installing a golf hole collar for preserving the shape and firmness of a golf hole while increasing the visibility of the golf hole, the collar abutting an earthen strip above the cup liner which forms the bottom and sides of the golf hole, the collar having an upper perimeter having a uniform cylindrical shape and a lowermost perimeter having a uniform cylindrical shape, such method incorporating the use of a cup setter, the cup setter having a base with a side for flushly engaging the earth surrounding the hole and a cylindrical member extending from the base for pushing the liner into the hole a specific depth below the surface of the earth engaged by the base, the cylindrical member having a larger outside diameter portion adjacent the base for engaging the upper inner surface of the hole and a reduced outside diameter portion below the larger diameter portion for engaging and forcing the cup liner to the specified depth, the method of installing the golf hole collar comprising the steps of:

(a) coring a cylindrical golf hole;

(b) inserting the cup liner into the cylindrical golf hole;

(c) affixing the collar onto the cup setter such that the upper perimeter of the collar removeably engages the larger outside diameter portion of the cylindrical member of the cup setter and the lower perimeter of the collar removeably engages the cup setter so as to have an inclined relationship therebetween such that the portion of the collar closest to the base remains displaced from the base a fixed uniform distance;

(d) engaging the cup setter, with the collar affixed thereto, with the cup liner such that the engagement of the collar with the liner is an interlocking configuration to provide a secure unmoving relationship;

(e) pushing the assembly comprising the cup setter, the collar and the liner into the cored golf hole until the side of the base flushly engages the earth surrounding the cored hole; and (f) removing the cup setter from the golf hole such that the collar and the liner remain securedly affixed in the cored golf hole and the collar remains displaced from the surface of the earth a fixed uniform distance corresponding to the distance the collar was displaced from the base.

* * * * *